US012146693B2

(12) United States Patent
Walker et al.

(10) Patent No.: US 12,146,693 B2
(45) Date of Patent: Nov. 19, 2024

(54) EVAPORATIVELY COOLED REFRIGERATION SYSTEM AND METHOD

(71) Applicant: SPX Cooling Technologies, Inc., Overland Park, KS (US)

(72) Inventors: Jonathan Walker, Brea, CA (US); Zan Liu, Overland Park, KS (US)

(73) Assignee: SPX Cooling Technologies, Inc., Overland Park, KS (US)

( * ) Notice: Subject to any disclaimer, the term of this patent is extended or adjusted under 35 U.S.C. 154(b) by 0 days.

(21) Appl. No.: 17/814,138

(22) Filed: Jul. 21, 2022

(65) Prior Publication Data

US 2023/0036380 A1 Feb. 2, 2023

Related U.S. Application Data

(60) Provisional application No. 63/224,600, filed on Jul. 22, 2021.

(51) Int. Cl.
*F25B 41/31* (2021.01)
*F25B 1/00* (2006.01)

(52) U.S. Cl.
CPC ..... *F25B 41/31* (2021.01); *F25B 1/00* (2013.01)

(58) Field of Classification Search
CPC ..... F25B 41/31; F25B 1/00
See application file for complete search history.

(56) References Cited

U.S. PATENT DOCUMENTS

2017/0122624 A1 5/2017 Zha et al.
2020/0284477 A1 9/2020 Hudson

FOREIGN PATENT DOCUMENTS

CN 207350986 U 5/2018

OTHER PUBLICATIONS

Extended European Search Report issued for European Patent Application No. 22 186 397.0 dated Nov. 30, 2022, 7 pages.

*Primary Examiner* — Nael N Babaa
(74) *Attorney, Agent, or Firm* — Husch Blackwell LLP

(57) ABSTRACT

An evaporatively cooled refrigeration system includes a refrigerant, a gas/liquid separator, an expansion valve in fluid connection to the gas/liquid separator, an evaporator to receive the refrigerant from the expansion valve, a compressor configured to compress the refrigerant in fluid connection to the evaporator, and a gas cooler in fluid connection to the compressor. The gas cooler includes an indirect heat exchanger to convey the refrigerant and facilitate heat from the refrigerant and a spray system to spray an evaporative coolant on the indirect heat exchanger. Evaporative cooling provided by the evaporative coolant on the coil is configured to cool the refrigerant below a dry bulb ambient air temperature.

20 Claims, 9 Drawing Sheets

500

| Location | Adiabatic Gas Cooler System | | | | | | | | | | | | |
|---|---|---|---|---|---|---|---|---|---|---|---|---|---|
| | LT | | MT | | Adiabatic Gas Cooler | | | | | | | | Annual Operation Cost |
| | Power (kW) | Annual Energy (kWh) | Power (kW) | Annual Energy (kWh) | Condensing Temperature (F) | Fan (kW) | Pump (kW) | Size/ Footprint (Sq/Ft) | Evaporation (Gal) | Cycles of Concentration | Blowdown (Gal) | Water Usage (Gal) | $ |
| California | 3.82 - 4.57 | 62,500 | 13.61 - 20.98 | 473,196 | 85.0 | 9.12 | 0.24 | 86.17 | 277,001 | 2.50 | 184,667 | 461,671 | 164,895 |
| New York | 3.82 - 4.57 | 63,389 | 14.49 - 22.38 | 361,882 | 87.5 | 9.12 | 0.485 | 8.617 | 237,857 | 2.50 | 158,571 | 396,431 | 144,206 |
| North Dakota | 3.82 - 4.57 | 63,084 | 13.61 - 20.98 | 319,330 | 85.0 | 9.12 | 0.24 | 86.17 | 190,112 | 2.50 | 126,742 | 316,857 | 59,677 |

FIG. 5

600

| Location | Evaporative Cooler System | | | | | | | | | | | | |
|---|---|---|---|---|---|---|---|---|---|---|---|---|---|
| | LT | | MT | | Evaporative Cooler | | | | | | | | Annual Operation Cost |
| | Power (kW) | Annual Energy kWh | Power (kW) | Annual Energy (kWh) | Condensing Temperature (F) | Fan (kW) | Pump (kW) | Size / Footprint (Sq/Ft) | Evaporation (Gal) | Cycles of Concentration | Blowdown (Gal) | Water Usage (Gal) | $ |
| California | 3.82 - 4.57 | 62,500 | 12.78 - 19.68 | 319,064 | 80.0 | 7.355 | 2.207 | 64.46 | 923,337 | 3.30 | 401,451 | 1,324,788 | 93,881 |
| New York | 3.82 - 4.57 | 63,382 | 13.61 - 21.8 | 292,482 | 85.00 | 5.516 | 2.207 | 64.46 | 792,857 | 7.70 | 118,337 | 911,194 | 94,862 |
| North Dakota | 3.82 - 4.57 | 63,077 | 13.11 - 20.2 | 257,788 | 82.00 | 5.516 | 2.207 | 64.46 | 633,708 | 5.50 | 140,824 | 774,532 | 93,881 |

FIG. 6

700

| | Annual Energy Cost | | Annual Water Usage Cost | | Overall Annual Cost |
|---|---|---|---|---|---|
| | Adiabatic System | Evaporative System | Adiabatic System | Evaporative System | Ratio |
| California | $ 156,754 | $ 126,979 | $ 8,142 | $ 22,655 | 91% |
| New York | $ 140,654 | $ 120,280 | $ 3,553 | $ 6,268 | 88% |
| North Dakota | $ 55,427 | $ 49,759 | $ 4,250 | $ 9,059 | 99% |

FIG. 7

EVAPORATIVELY COOLED REFRIGERATION SYSTEM AND METHOD

CROSS-REFERENCE TO RELATED APPLICATION

This application is a Non-Provisional application and claims priority under 35 U.S.C. § 119 to U.S. Provisional Application Ser. No. 63/224,600, filed on Jul. 22, 2021, titled, "EVAPORATIVELY COOLED REFRIGERATION SYSTEM", the disclosure of which is incorporated herein by reference in its entirety.

FIELD OF THE INVENTION

The present disclosure relates to an evaporatively cooled refrigeration system for refrigerants with a low critical temperature. More particularly, the present disclosure relates to a refrigeration system with an evaporatively cooled condenser and/or gas cooler for refrigerants with a low critical temperature.

BACKGROUND OF THE INVENTION

Heat rejection devices are widely used in many applications to exchange heat and/or provide cooling. Particular applications for heat rejection devices may include refrigeration for supermarkets, process cooling in industry, and climate control in buildings. While heat rejection is generally well understood, a number of different principles are briefly discussed for reference. A supercritical fluid (SCF) is any substance at a temperature and pressure above its critical point, where distinct liquid and gas phases do not exist. The SCF expands to fill its container like a gas but with a density similar to that of a liquid. Typically, refrigeration systems using a refrigerant with a low critical temperature utilize a transcritical cycle to reject heat to the ambient environment. The transcritical cycle is a closed thermodynamic cycle where the refrigerant goes through both subcritical and supercritical states. While many substances have a critical temperature, only substances that have a critical temperature within a useful range of temperatures and pressures are suitable for use as refrigerants.

Traditionally, chlorofluorocarbons (CFCs) have been utilized as refrigerants. However, due to the negative impact CFCs have on the environment, other refrigerant chemistry is needed.

Accordingly, it is desirable to provide an evaporative heat rejection device for refrigerants with a low critical temperature that can offer improved performance or efficiency and/or without undesirably impacting the environment, increasing the size of the unit, the manufacturing cost of the unit, and/or operating cost of the unit.

SUMMARY OF THE INVENTION

The foregoing needs are met, at least in part, by the present disclosure where, in one embodiment an evaporative heat rejection device is disclosed.

An embodiment provides an evaporatively cooled refrigeration system. The evaporatively cooled refrigeration system includes a refrigerant, a gas/liquid separator, an expansion valve in fluid connection to the gas/liquid separator, an evaporator to receive the refrigerant from the expansion valve, a compressor configured to compress the refrigerant in fluid connection to the evaporator, and a gas cooler in fluid connection to the compressor. The gas cooler includes an indirect heat exchanger to convey the refrigerant and facilitate heat from the refrigerant and a spray system to spray an evaporative coolant on the indirect heat exchanger. The gas cooler optionally includes a direct heat exchanger. Evaporative cooling provided by the evaporative coolant on the indirect heat exchanger is configured to cool the refrigerant below a dry bulb ambient air temperature.

Another embodiment relates to a device that includes a gas cooler. The gas cooler includes an indirect heat exchanger and a spray system. The indirect heat exchanger has a coil to convey a refrigerant and facilitate heat removal from the refrigerant. The spray system is designed to spray an evaporative coolant on the indirect heat exchanger. The evaporative cooling is provided by the evaporative coolant on the coil and is configured to cool the refrigerant below a dry bulb ambient air temperature.

In yet another embodiment, an evaporatively cooled refrigeration system comprises a distribution system for providing an evaporative coolant to an indirect heat exchanger. The indirect heat exchanger includes a coil configured to cool a refrigerant flowing through the coil below a dry bulb ambient air temperature by transferring heat from the refrigerant to the evaporative coolant that passes over the coil. The evaporatively cooled refrigeration system further includes a pressure relief valve configured to automatically open at a pressure of about 1600 pounds per square inch (PSI) or greater. The indirect heat exchanger is configured to withstand a pressure of at least about 1000 PSI.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 5 is a table showing operating parameters of an exemplary adiabatic gas cooler in three different geographical locations;

FIG. 6 is a table showing operating parameters of the evaporative gas cooler of FIGS. 1A-1B and FIG. 3 in the three different geographical locations of FIG. 5; and FIG. 7 is a table showing a predicted cost comparison between the exemplary adiabatic gas cooler of FIG. 5 and the evaporative gas cooler of FIG. 6 in the three different geographical locations.

DETAILED DESCRIPTION

Figure 1A:
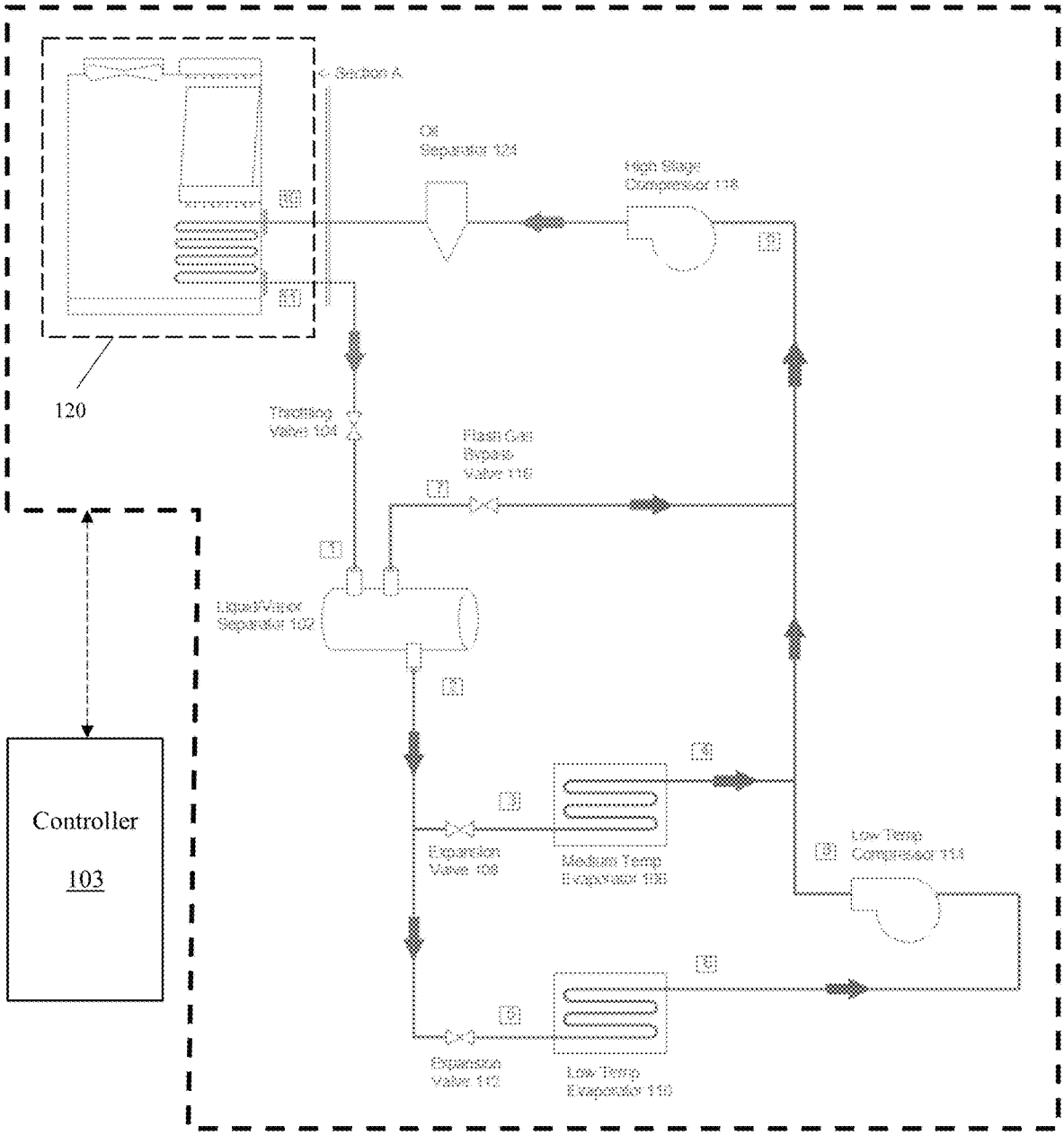
FIG. 1A is a simplified system schematic of an evaporatively cooled refrigeration system having a gas cooler according to an embodiment.

In general, embodiments of an evaporatively cooled refrigeration system described herein refer to various forms of evaporative condensers, gas coolers, and other such heat transfer/rejection devices for use with a refrigerant having a low critical temperature. For the purposes of this disclosure, the term, "low critical temperature" refers to a substance having a critical temperature between about 0° C. and about 100° C., or 0° C. and 100° C. More particularly, the term, "low critical temperature" refers to a substance having a critical temperature between about 10° C. and about 40° C., or 10° C. and 40° C.

One or more embodiments of the evaporatively cooled refrigeration system may be designed to operate as correlated to the ambient wet-bulb temperature of the air, as opposed to the ambient dry-bulb temperature. Throughout many locations, wet-bulb temperatures may be less than 27° C. throughout the majority of the year.

The evaporatively cooled refrigeration system may be configured to operate and stay below the critical point of carbon dioxide ($CO_2$). $CO_2$ has a low critical temperature (31° C.) and high critical pressure (73.8 Bar). Using ammonia as a reference, the critical temperature and critical pressure of ammonia is 132° C. and 113 Bar, respectively. In warm climates, the low critical temperature of $CO_2$ means the system would operate beyond the critical point using a transcritical $CO_2$ system. Transcritical operation results in a significant higher compressor energy consumption, higher compressor first cost, and less compressor life.

Furthermore, in comparison to embodiments utilizing evaporative cooling, air cooled and adiabatic cooled $CO_2$ condensing/cooling technologies require significantly greater heat rejection energy and/or much larger heat transfer surface area. It is an advantage of some embodiments that the evaporatively cooled refrigeration system is configured to operate with either condensing refrigerant vapor below its critical temperature, or cool refrigerant supercritical fluid above its critical temperature.

Moreover, $CO_2$ has a low toxicity and low environmental impact as compared with conventional refrigerants. For example, the carbon footprint of $CO_2$ is 1 global-warming potential (GWP). Further $CO_2$ has an Ozone depletion potential (ODP) of 0. However, common refrigerants such as R-12 and R-22 have a GWP of 10,800 and 1,760, and an OPD of 0.73 and 0.034, respectively. Thus, there is a movement in the refrigeration industry to phase out the use of high GWP and ODP refrigerants.

Embodiments of the evaporatively cooled refrigeration system may include evaporative condenser coils configured to operate at internal pressures of about 120 Bar. The materials of the evaporative condenser coils are designed to be sufficiently corrosion-resistant to operate in a wetted environment. For example, the coils may be comprised of stainless steel, copper, galvanized steel, aluminum, or other similar materials. If the system operates in the supercritical state, the evaporative cooling technology is designed to operate at a low energy consumption compared to air cooled and adiabatic cooled systems, from both the compression and heat-rejection processes.

In some warm climates, a refrigeration system using the $CO_2$ may be configured to operate as a transcritical system. When the high side of the $CO_2$ refrigeration system operates in the supercritical state, it consumes significantly more energy from both the compression and the supercritical fluid (gas) cooling processes. By being configured to provide an evaporative cooled high side heat rejection, embodiments of the disclosure facilitate operation in the subcritical state for as many hours during a year as possible. If the evaporatively cooled refrigeration system operates in the supercritical state due to an elevated environmental temperature, for example, the evaporative cooling technology facilitates a lower system energy consumption compared to air cooled and adiabatic cooled systems.

Figure 3:
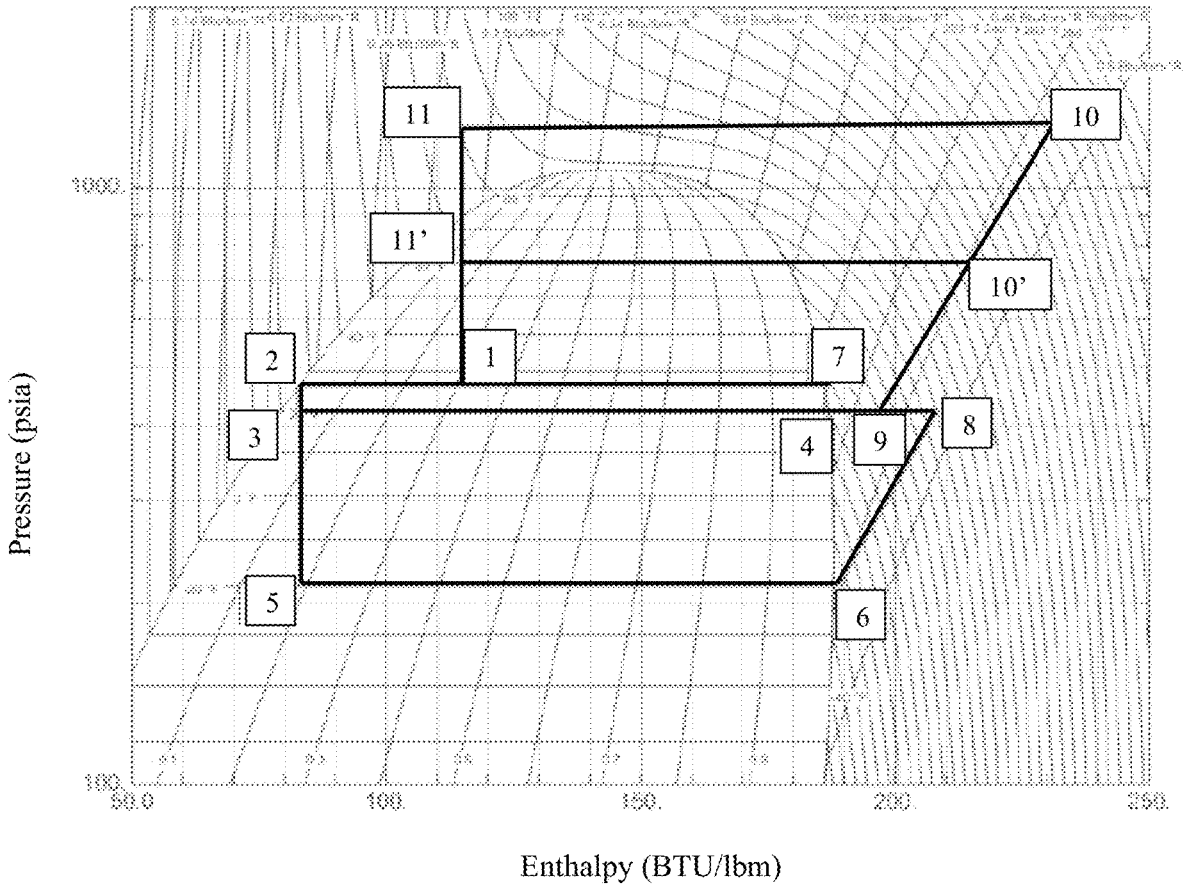
FIG. 3 is a diagram of fluid properties plotted against pressure (ordinate) verses enthalpy (abscissa) of a refrigerant suitable for use in the evaporatively cooled refrigeration system of FIG. 1A.

Referring now to FIGS. 1A-3 of the drawings, a detailed description of the operation of an evaporatively cooled refrigeration system is disclosed. Specifically, FIGS. 1A-1B illustrate a simplified system schematic of an evaporatively cooled refrigeration system 100. FIGS. 2A-2D illustrate various isometric views of a gas cooler 120 of FIGS. 1A and 1B. FIG. 3 is a diagram of fluid properties plotted against pressure (ordinate) verses enthalpy (abscissa) of an evaporatively cooled refrigeration system as described in the above embodiments. By comparing FIGS. 1A-1B and 3, the energy efficiency of the evaporatively cooled refrigeration system 100 can be seen.

Referring specifically to FIG. 1A, at step 1, a flow of a refrigerant (e.g., $CO_2$) enters a liquid/vapor separator 102. The refrigerant may pass through a throttling valve 104. After passing through the throttling valve 104, the refrigerant may be provided in the form of a liquid/vapor mixture at an intermediate pressure, for example, about 33 Bar. Depending on the pressure and temperature of the gas cooler 120, the liquid/vapor mixture may have a quality around 0.3, meaning it is 70% liquid, 30% vapor (by mass). The liquid/vapor mixture separates into liquid and vapor in the separator 102 due to the difference in density of the two states.

At step 2, liquid refrigerant may be drawn from the bottom of the separator 102. For example, located at the bottom of the separator 102, a port provides an exit for the refrigerant to be drawn from the separator 102 as a saturated liquid, typically around −1° C. and 33 Bar.

At step 3, the flow of refrigerant is provided to one or more medium temperature evaporators 106. For example, the liquid refrigerant is conveyed through an expansion valve 108 and enters the one or more medium temperature evaporators 106. Preferably, the refrigerant experiences a limited amount of expansion as it passes through the expansion valve 108 and enters the one or more medium temperature evaporators 106. For example, the refrigerant may be nearly saturated at about −6.7° C. and 28 Bar as it enters the one or more medium temperature evaporators 106. As is generally understood, once the refrigerant enters the one or more medium temperature evaporators 106, the refrigerant absorbs heat. For example, the one or more medium temperature evaporators 106 may be designed to have a rejection heat load of about 510,600 British thermal units per hour (BTU/hr).

It is to be understood that although FIG. 1A shows the evaporatively cooled refrigeration system 100 comprising one medium temperature evaporator 106, this is not to be considered limiting. The evaporatively cooled refrigeration system 100 may comprise more or fewer medium temperature evaporators 106 depending on the embodiment. For example, for higher heat load systems, more than one medium temperature evaporator 106 may be needed.

At step 4, the refrigerant exits the one or more medium temperature evaporators 106. Having gained heat in the one or more medium temperature evaporators 106, the refrigerant is provided in the form of a vapor having a small amount of superheat of less than 10° F., and at a pressure of about 28 Bar.

At step 5, the refrigerant may be conveyed to one or more low temperature evaporators 110. For example, the liquid refrigerant may be conveyed from the separator 102 to a low temperature expansion value 112. The flow of refrigerant is supplied to the one or more low temperature evaporators 110 at about −28.9° C. and 13.8 Bar. As is generally understood, once the refrigerant enters the one or more low temperature evaporators 110, the refrigerant absorbs heat. For example, the one or more low temperature evaporators 110 may have a rejection heat load of about 138,800 BTU/hr.

It is to be understood that although FIG. 1A shows the evaporatively cooled refrigeration system 100 comprising one low temperature evaporator 110, this is not to be considered limiting. The evaporatively cooled refrigeration system 100 may comprise more or fewer low temperature evaporators 110 depending on the embodiment. For example, for higher heat load systems, more than one low temperature evaporator 110 may be needed.

It is to be further understood that although FIG. 1A shows the evaporatively cooled refrigeration system 100 as a two-stage system (i.e., having one or more medium temperature evaporators 106 and one or more low temperature evaporators 110), this is not to be considered limiting. In one embodiment, the evaporatively cooled refrigeration system 100 may be a single-stage system having either the medium temperature evaporator 106 or the low temperature evaporator 110.

At step 6, the refrigerant exits the one or more low temperature evaporators 110. For example, having gained heat in the one or more low temperature evaporators 110, the refrigerant is provided in the form of a vapor with a small amount of superheat, typically less than 10° F., and at a pressure of about 13.8 Bar. This flow of refrigerant exiting the one or more low temperature evaporators 110 provides a suction for one or more low temperature compressors 114 provided downstream of the low temperature evaporators. The flow of refrigerant is designed to be compressed by the one or more low temperature compressors 114 as described in more detail hereinbelow.

Referring again to the liquid/vapor separator 102, at step 7, a flash gas (e.g., excess vapor that has boiled off the liquid refrigerant in the separator 102) is removed from the liquid/vapor separator 102. A flash gas bypass valve 116 may be provided and is configured to meter a flow of the flash gas from the separator 102. In a particular example, the metered flow of the flash gas may be a saturated vapor provided at a pressure of about 33 Bar. The metered flow of the flash gas is then combined with an amount of compressed flow of refrigerant that is exiting the one or more low temperature compressors 114, and the combined stream is conveyed to one or more high stage compressors 118. The combined stream is designed to control or modulate the pressure of the separator 102 and the superheat supplied to the suction of the one or more high stage compressor(s) 118.

At step 8, the compressed flow of refrigerant exits the one or more low temperature compressors 114. For example, the one or more low temperature compressors 114 may have compressed the refrigerant to slightly above the high stage suction pressure, about 28.3 Bar. The refrigerant also has superheat leaving the one or more low temperature compressors 114 at around 93° C. The number of the one or more low temperature compressors 114 may depend on the needs of the embodiment. Thus, the amount of superheat leaving the one or more low temperature compressors 114 can vary.

At step 9, the flow of refrigerant is provided to one or more high stage compressors 118. In this instance, a high stage compressor head serves to converge the flow of refrigerant from the outlet of the low temperature compressor(s) 114, the outlet of the medium temperature evaporator(s) 106, and the flash gas bypass valve 116. The converged flow of refrigerant is provided to the one or more high stage compressors 118 and compressed.

It is to be understood that the evaporatively cooled refrigeration system 100 depicted herein is designed to operate at a low pressure during steps 1-9. Thus, the piping and one or more components of the portion of the evaporatively cooled refrigeration system 100 on the "low side" may be rated for low pressure environments. One of the benefits of using $CO_2$ as a refrigerant is that the piping on the low side may be smaller than conventional refrigeration systems. For example, at −22° F., R-22 has a vapor density of about 0.43 pounds per cubic foot (lbs/ft$^3$). Whereas, at the same temperature, $CO_2$ has a vapor density of about 2.2 lbs/ft$^3$. Thus, the same mass flow rate of $CO_2$ can be transported through a smaller pipe as compared to R-22.

Referring again to FIG. 1A, at step 10, the flow of refrigerant is discharged from the high stage compressor(s) 118, where the flow of refrigerant then enters the gas cooler 120, which is described in further detail below. In this instance, the refrigerant has been compressed and is now at the highest temperature and pressure in the evaporatively cooled refrigeration system 100. For example, Table 1 shows the pipe schedule required for various nominal pipe sizes for the "high side" of the evaporatively cooled refrigeration system 100.

TABLE 1

High Pressure Piping Specifications

| Nominal Pipe Size (NPS) | Pipe Schedule |
|---|---|
| 0.75 | |
| 1 | 40 |
| 1.25 | 80 |
| 1.5 | 80 |
| 2 | 160 |
| 2.5 | 160 |
| 3 | 160 |
| 4 | 80/160 |
| 5 | 40/80/160 |
| 6 | 40/80/160 |

At an inlet 180 of an indirect heat exchanger 140 of the gas cooler 120, as further explained below, the coupling between the inlet 180 and the pipe leading from the high stage compressor 118 must also be able to withstand the high pressure and temperature described above. Further, the high-pressure portion of the evaporatively cooled refrigeration system 100 may comprise one or more safety relief valves configured to automatically vent at about 1600 psi. Accordingly, a pipe coupling 128 between the inlet 180 of the indirect heat exchanger 140 and the pipe leading from the high stage compressor 118 must be capable of withstanding about 1600 psi without separating or leaking.

The discharge of the high stage compressor 118 may pass through an oil separator 124. The refrigerant that is discharged from the high stage compressor(s) 118 is also provided to the inlet 180 of the gas cooler 120. The gas cooler 120 may be provided in the form of a gas condenser. The gas cooler 120 is configured to provide evaporative cooling. In some forms, an adiabatic cooler is not provided in the evaporatively cooled refrigeration system 100. In this manner, efficient cooling/condensing of refrigerants with low critical temperatures may be achieved. Primarily the throttling valve 104, along with capacity modulation of the gas cooler 120, controls the pressure at this point while the refrigerant is passing through the cooler. During transcritical operation, when the ambient dry bulb temperature, or adiabatically pre-cooled air dry bulb temperature is greater than the $CO_2$ critical temperature (31° C.), an air-cooled or adiabatically cooled refrigeration system (as compared to the evaporatively cooled refrigeration system 100 shown in FIG. 1A) operates at the supercritical region of the pressure verses enthalpy diagram illustrated in FIG. 3. The temperature of the $CO_2$ may reach between 121° C. and 149° C. and 93 Bar to 103 Bar. The compression process consumes a significant amount of energy and thus adds a significant amount of additional waste heat to be rejected to the ambient atmosphere from the low stage compression process (steps 6-8).

As best seen in FIG. 3, at step 10', during subcritical operation, the refrigerant is evaporatively cooled. In subcritical operation, the ambient heat sink is with reference to the wet bulb temperature.

As shown in FIGS. 2A-2D, the gas cooler 120 for use in the systems described herein may include a housing 210 that surrounds the internal components of the gas cooler 120. Referring to FIGS. 1B, and 2A-2D, the gas cooler 120 may include a first distribution system 130 designed to supply an evaporative fluid, such as water, water solution, or the like to a direct heat exchanger 136. In a simplified example, water may be provided to and directly sprayed onto the direct heat exchanger 136. The first distribution system 130 may further include a hot water basin 132 and a first plurality of nozzles 150 configured to distribute water to the direct heat exchanger 136. In use, water may cascade down sheets of fill media disposed in the direct heat exchanger 136. An air movement device 134, such as a fan, draws a flow of air through the fill media to evaporatively cool the evaporative fluid. The flow of air may then enter the direct heat exchanger 136 through an upper air inlet 230. In various examples, the air movement device 134 may include more than one fan and the size may vary depending upon the size of the gas cooler 120 and specific application. Thus, the direct heat exchanger 136 is designed to cool the evaporative fluid from a first temperature to a second temperature less than the first temperature.

In some embodiments, the cooled evaporative fluid may be collected in a second distribution system 160 comprising an intermediate basin 138 and a second plurality of nozzles 162 configured to spray the evaporative fluid onto the indirect heat exchanger 140. However, in some other embodiments, the evaporatively cooled refrigeration system 100 may not include the intermediate basin 138. Thus, the evaporative fluid may pass through the direct heat exchanger 136 and then be provided for use with the indirect heat exchanger 140 without flowing through a secondary distribution system. In some examples, the indirect heat exchanger 140 may include one or more cooling/condensing coils, a plate heat exchanger, or the like. The indirect heat exchanger 140 may further include a drift eliminator 220. The indirect heat exchanger 140 is configured to cool the refrigerant flowing through the tube side of the indirect heat exchanger 140 by transferring heat from the refrigerant to the evaporative fluid. Thus, the evaporative fluid increases in temperature after contacting the indirect heat exchanger 140. The refrigerant may be provided to and enter the indirect heat exchanger 140 at the inlet 180 and exit the indirect heat exchanger 140 at an outlet 182. To aid in the transfer of heat via the indirect heat exchanger 140, the air movement device 134 may draw air in from a lower air inlet 240 and through the indirect heat exchanger 140.

A collection basin 142 may be provided to collect the hot evaporative fluid that has passed over the indirect heat exchanger 140. A recirculation system may then convey the hot evaporative fluid from the collection basin 142 to the hot water basin 132 in a well understood manner. In one non-limiting example, the recirculation system includes a pump 170 and piping 172. In this way, the evaporative fluid may be cycled over the gas cooler 120. However, due to evaporation, a supply of fresh water may be supplied to the gas cooler 120 to maintain a desired evaporative fluid volume. For example, the evaporative fluid may be cycled through the evaporatively cooled refrigeration system 100 at least three times before the evaporative fluid may need to be removed from the evaporatively cooled refrigeration system 100 through blowdown.

In most climates, the ambient wet bulb is 27° C. or lower. The highest temperature and pressure point of the evaporatively cooled refrigeration system 100 hence would be able to stay below the $CO_2$ critical point. Referring again to FIG. 3, instead of a transcritical compression process from 9 to 10, the evaporatively cooled refrigeration system 100 is designed to operate at a subcritical compression process from 9 to 10'. The line lengths of 10-11 and 10'-11' is proportional to the energy of the waste heat to be rejected from both the low stage and high stage compression processes. Since the line length of 10'-11' is shorter than 10-11, it represents a reduced total compression energy consumed. It is an advantage of the evaporatively cooled refrigeration system 100 that the gas cooler 120 is configured to utilize evaporative cooling which increases a percentage of time the evaporatively cooled refrigeration system 100 operates subcritically in comparison to a system that lacks evaporative cooling. In this manner, the evaporatively cooled refrigeration system 100 minimizes the pressure required and associated energy consumption. Even in rare climates (or extreme hot hours) in which the ambient wet bulb is higher than the $CO_2$ critical temperature, the evaporatively cooled refrigeration system 100 facilitates a transcritical compression line below line 10-11 which indicates a lower pressure and temperature compression compared line 10-11.

As shown in FIG. 3, at step 11, heat has been removed from the refrigerant via the gas cooler 120 and the refrigerant exits the gas cooler 120. In transcritical mode, the refrigerant at this point is provided as an undefined fluid, as opposed to a liquid or a gas.

In contrast, at step 11', the refrigerant exits the gas cooler 120 as a liquid. In subcritical mode, the refrigerant at this point is a liquid and heat has been removed from the refrigerant via the gas cooler 120.

At step 12, the refrigerant cycle is completed as the refrigerant exits the outlet of the throttling valve 104. When passing through the throttling valve 104, the flow of refrigerant from the gas cooler 120 has been reduced in pressure to the pressure substantially equivalent to, or equal to the pressure within the liquid/vapor separator 102. In transcritical mode, the refrigerant here is a mixture of liquid and gas. In subcritical mode, the refrigerant is 100% liquid. Thus, piping downstream of the throttling valve 104 may be rated for lower pressure operation.

Figure 4:
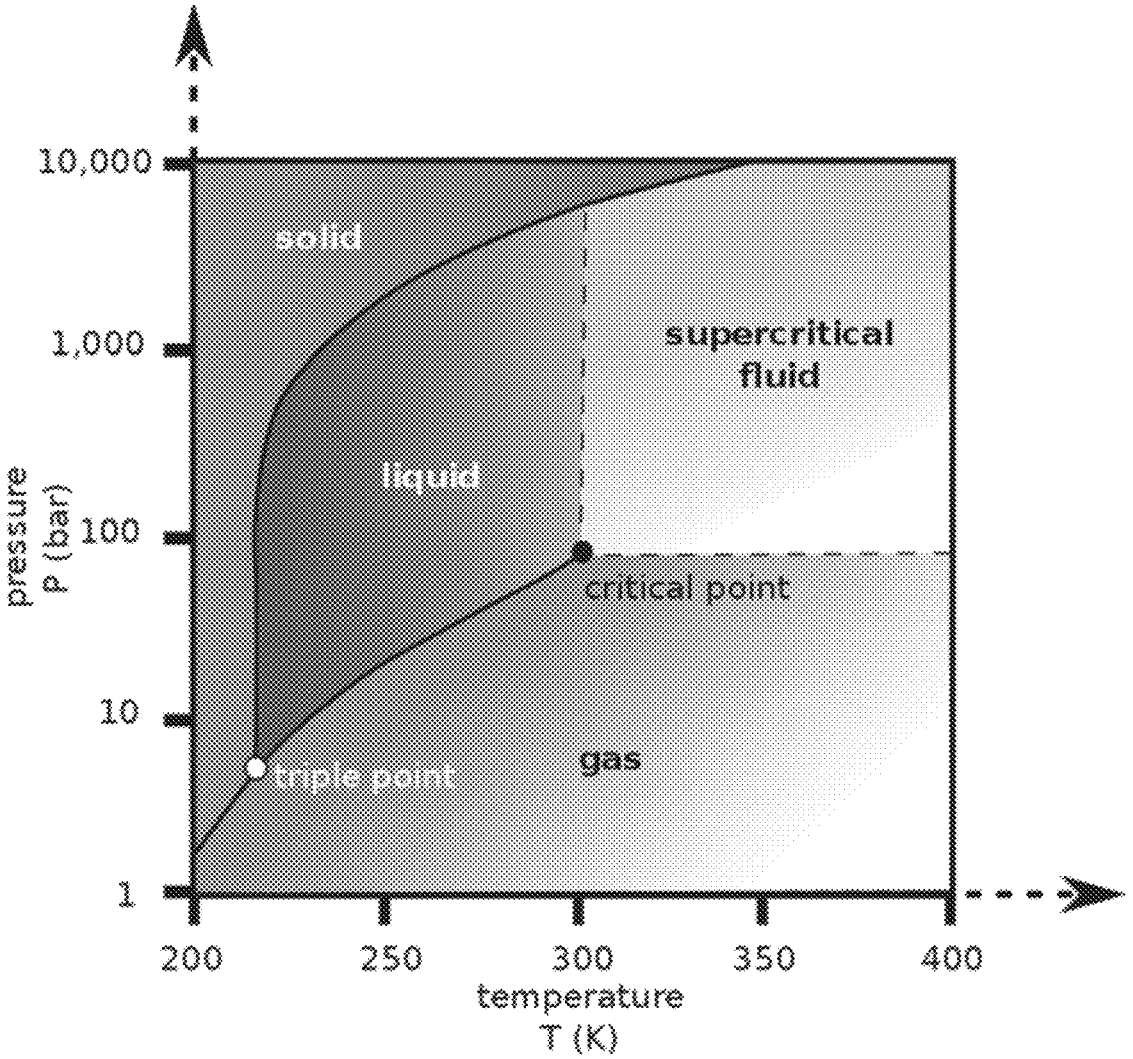
FIG. 4 is a diagram of fluid properties of carbon dioxide ($CO_2$) plotted against pressure (ordinate) verses temperature (abscissa) suitable for use as the refrigerant in the evaporatively cooled refrigeration system of FIG. 1A.

FIG. 4 is a diagram of fluid properties of carbon dioxide ($CO_2$) plotted against pressure (ordinate) verses temperature (abscissa) suitable for use as the refrigerant in the evaporatively cooled refrigeration system 100. As shown in FIG. 4, the critical point of carbon dioxide is about 300° K (31° C.) and about 74 Bar.

In many climates, the annual operating cost of the evaporatively cooled refrigeration system 100 is lower than the annual operating cost of a conventional adiabatic cooled refrigeration system with respect to the cost of water usage and energy usage in the instance where each of the evaporatively cooled refrigeration system 100 and the conventional adiabatic cooled refrigeration system provide substantially the same cooling capacity. For example, for a climate C1 with a mean coincident wet bulb temperature of MCWB1, a dry bulb temperature of DB1, and a wet bulb temperature of WB1, having water cost WC1 USD/Gal and energy cost EC1 USD/kWh, the conventional adiabatic cooled refrigeration system has a total annual cost of TACA1 to provide X BTU output. In contrast, in the same climate C1 and providing the same X BTU output, the evaporatively cooled refrigeration system 100 has a total annual cost of TACE1 which is less than TACA1. In C1, the annual energy use AEU1 of the evaporatively cooled refrigeration system 100 is less than the annual energy use AEU2 of the conventional adiabatic cooled refrigeration system. In some climates, the annual water use AWU1 of the evaporatively cooled refrigeration system 100 is higher than the annual water use AWU2 of the conventional adiabatic cooled refrigeration system. However, AEU1×EC1+AWU1×WC1 is less than AEU2×EC1+AWU2×WC1, and, therefore, TACE1 is less than TACA1. Accordingly, the cost savings in annual energy use of the evaporatively cooled refrigeration system 100 outweighs the cost of any additional water use. This is found to be true for a wide range of energy costs EC1, water costs WC1, and climates C1.

In FIGS. 5-7, a few examples are provided that illustrate the differences between a conventional adiabatic cooled refrigeration system and the evaporatively cooled refrigeration system 100 to amplify and elaborate on the foregoing concepts.

Turning to FIG. 5, a Table 500 comprising simulated operating parameters for a conventional adiabatic system is shown. The table includes values for an adiabatic system operated in three different simulated geographical environments—California, New York, and North Dakota. Each of the three locations have different average climate conditions (e.g., weather) such as temperature and humidity. California is simulated as having a mean coincident wet bulb temperature of 65.6° F., a dry bulb temperature of 91.4° F., and a wet bulb temperature of 71.3° F. New York is simulated as having a mean coincident wet bulb temperature of 73.7° F., a dry bulb temperature of 91° F., and a wet bulb temperature of 76.7° F. North Dakota is simulated as having a mean coincident wet bulb temperature of 69.3° F., a dry bulb temperature of 90.5° F., and a wet bulb temperature of 73.5° F.

Figure 1B:
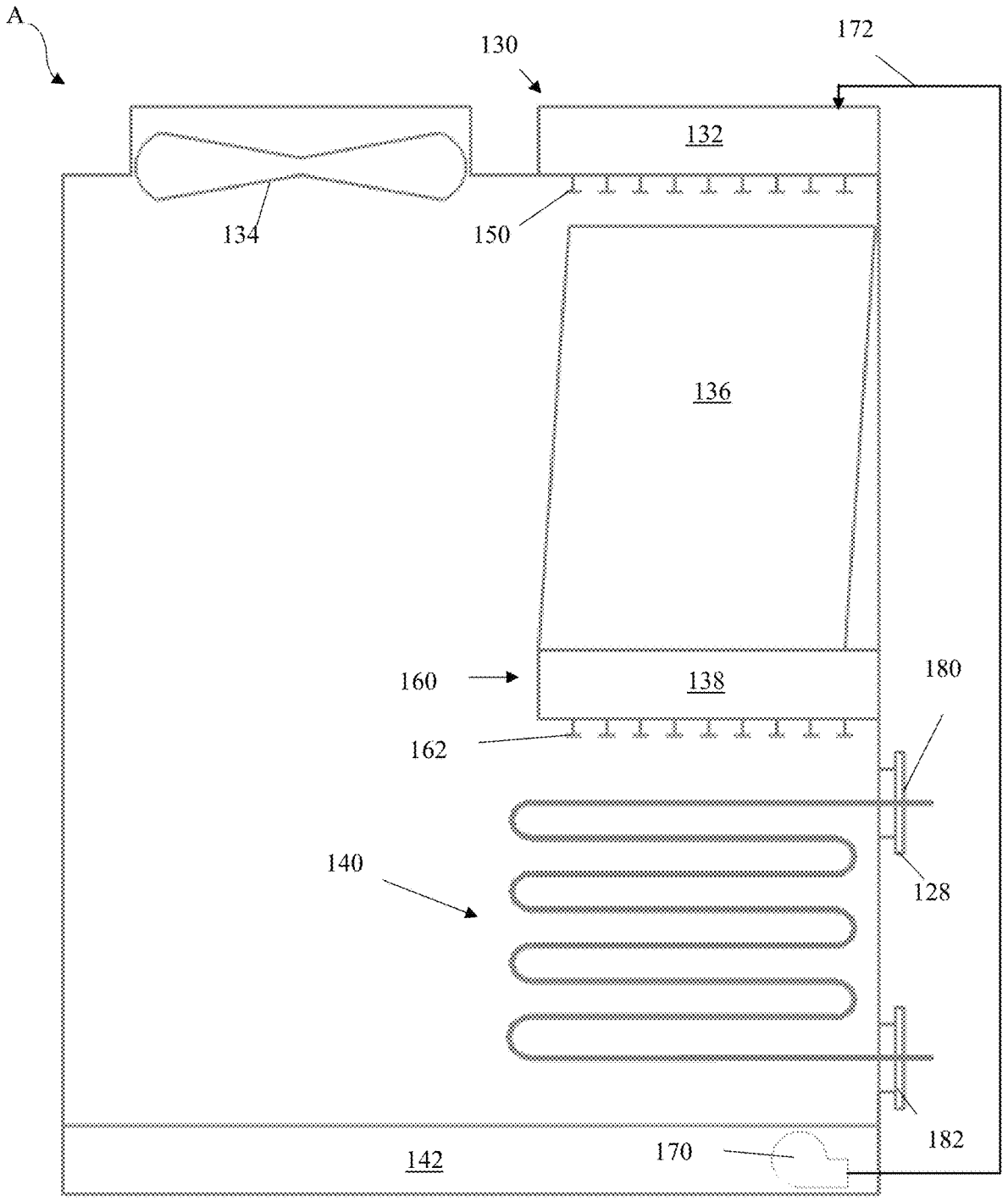
FIG. 1B is a detailed schematic view of the gas cooler of FIG. 1A.
Figure 2A:
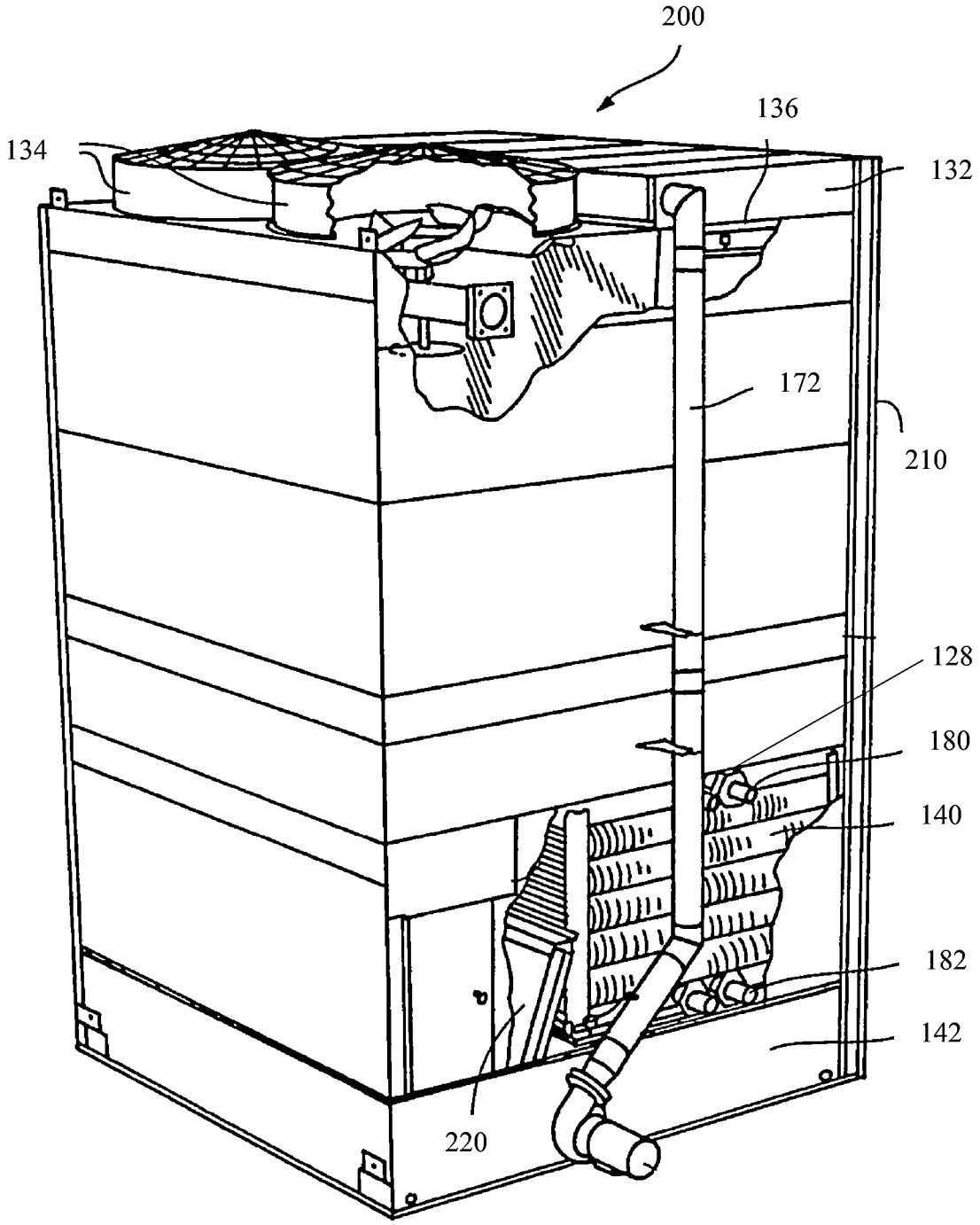
FIG. 2A is an isometric view of the gas cooler of FIG. 1B, with portions of a housing removed therefrom for clarity.
Figure 2B:
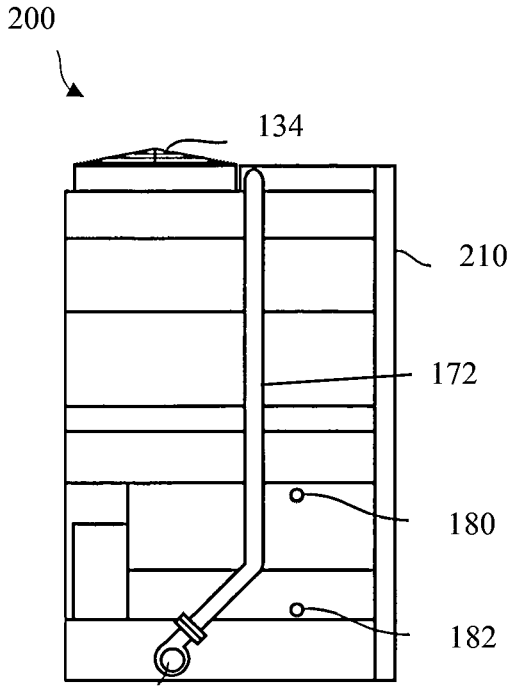
FIG. 2B is a side elevational view of the gas cooler of FIG. 1B.
Figure 2C:
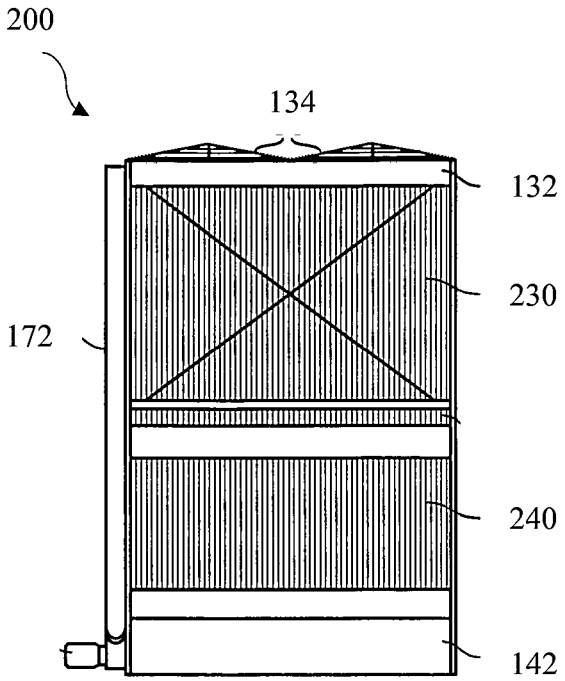
FIG. 2C is a front elevational view of the gas cooler of FIG. 1B.
Figure 2D:
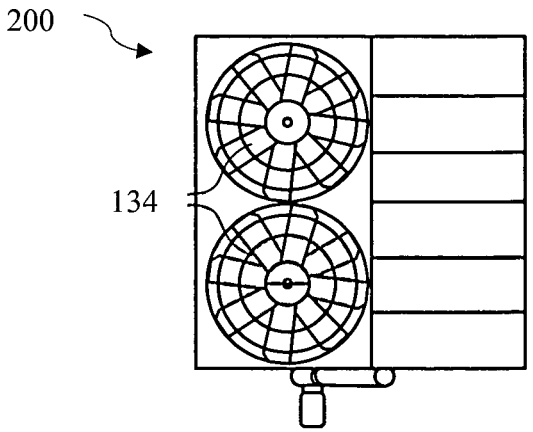
FIG. 2D is a top elevational view of the gas cooler of FIG. 1B.

FIG. 6 shows a Table 600 that comprises simulated operating parameters for an evaporative cooler system, such as the evaporatively cooled refrigeration system 100 of FIGS. 1A-1B. The Table 600 displays the operating parameters of the evaporatively cooled refrigeration system 100 in the same simulated environments provided for the adiabatic system, e.g. California, New York, and North Dakota, with the above-referenced climate characteristics.

Each of the adiabatic and the evaporative cooler systems of FIGS. 5 and 6 are designed to have a cooling capacity of about 24,000 BTUs to about 36,000 BTUs. An Annual Operation Cost for each system was calculated for the three different geographical locations. The Annual Operation Cost may be a function of water cost (CW) and energy cost (CE).

By comparing the values in Table 500 to Table 600, it can be seen that the evaporative cooler system has a lower Annual Operation Cost compared to the adiabatic system. As shown in Table 600, the evaporative cooler system may have a lower annual operation cost because the evaporative cooler may have a lower power requirement for a fan, such as the air movement device 134 of FIG. 1B. Thus, less power may be needed; thereby reducing cost. Further, the evaporative cooler may be able to operate at higher cycles of concentration of the evaporative coolant fluid which may reduce cost. Moreover, the evaporative refrigeration system may achieve the same cooling capacity as the adiabatic cooler system but also may be provided with a footprint (e.g., size of the housing and/or system) and/or overall size that is between about 66 to about 75 percent of the size of the adiabatic cooler. In some forms, the conventional adiabatic cooled refrigeration system has a footprint $X^2$ and the evaporatively cooled refrigeration system 100 has a footprint $Y^2$. In some forms, despite providing substantially the same cooling capacity, the ratio of $X^2$ to $Y^2$ is between about 1:2 to about 2:3. By having a smaller footprint, the amount of materials needed to construct the system may be reduced and the available land needed may be smaller; thereby saving on material and land cost. Thus, not using an adiabatic cooling system, and instead using the evaporatively cooled refrigeration system 100 saves both money and space.

A summary of the Overall Annual Cost of the Adiabatic System of FIG. 5 and the Evaporative System of FIG. 6 is shown in Table 700 of FIG. 7. As can be seen, in a variety of environments, the evaporative cooler system has a lower Overall Annual Operation Cost even when the evaporative cooler system operates at higher water usage rates because the energy requirements of the evaporative cooler system is lower than that of a conventional adiabatic system.

Referring back to FIG. 1A, the evaporatively cooled refrigeration system 100 may be connected to a controller 103. The controller 103 may be connected to the evaporatively cooled refrigeration system 100 over a wireless network or a cable network. The controller 103 may be configured to receive information from and/or send commands to the evaporatively cooled refrigeration system 100. For example, the controller 103 may be configured to determine the ambient air temperature and the required heat load of the evaporatively cooled refrigeration system 100. Using this information, the controller 103 may adjust one or more components of the evaporatively cooled refrigeration system 100.

In one scenario, the controller 103 may adjust the fan speed of the air movement device 134 of FIGS. 1B and 2A-2D to achieve the lowest overall refrigeration system energy. When the ambient air temperature is colder, it may not be necessary to operate the air movement device 134 at a full rate. Thus, the fan speed may be reduced, thereby reducing energy cost.

In yet another scenario, the controller 103 may adjust the speed of the low temperature compressor 114 and/or the high stage compressor 118. For example, the evaporatively cooled refrigeration system 100 may have a low heat load, which does not require one or more of the compressors 114, 118 to operate at full speed. Thus, the controller 103 may be configured to reduce the speed of the low temperature compressor 114 and/or the high stage compressor 118. Therefore, the energy needs of the evaporatively cooled refrigeration system 100 may be reduced.

It is to be understood that the above examples are merely for illustrative purposes and are not to be considered limiting. The controller 103 may be configured to adjust multiple components of the evaporatively cooled refrigeration system 100 simultaneously.

Additionally, it is to be understood that carbon dioxide is one example of a suitable refrigerant for use in the evaporatively cooled refrigeration system 100. Other refrigerants having similar properties to that of carbon dioxide may be used. For example, the evaporatively cooled refrigeration system 100 may use refrigerants having one or more of the following properties: a low ODP (near zero), a low GWP, a low critical temperature (less than 45° C.), and a high critical pressure (greater than 700 psig).

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention. For example, the direct heat exchanger 136 could be placed below the indirect heat exchanger 140 and still maintain the advantages of the invention with the condensing and/or cooling of the refrigerant with reference to the wet bulb temperature by virtue of the evaporative cooling.

What is claimed is:

1. A refrigeration system, comprising:

a refrigerant;

a compressor configured to compress the refrigerant;

a gas cooler downstream of the compressor comprising:

a first distribution system configured to provide an evaporative coolant to a direct heat exchanger, wherein the direct heat exchanger is configured to cool the evaporative coolant from a first temperature to a second temperature less than the first temperature; and an indirect heat exchanger positioned downstream of the direct heat exchanger and configured to receive the evaporative coolant at the second temperature from the direct heat exchanger via distribution onto the indirect heat exchanger, the indirect heat exchanger comprising a coil configured to cool the refrigerant below a dry bulb ambient air temperature by transferring heat from the refrigerant to the evaporative coolant;

an evaporator downstream of the gas cooler and upstream of the compressor; and an expansion valve disposed in fluid connection downstream of the gas cooler and upstream of the evaporator.

2. The refrigeration system of claim 1, wherein the refrigerant is carbon dioxide, and the evaporative coolant is water.

3. The refrigeration system of claim 1, wherein the direct heat exchanger includes fill media.

4. The refrigeration system of claim 1, further including a fan to generate a flow of air across the indirect heat exchanger and a recirculation pipe to recycle the evaporative coolant.

5. The refrigeration system of claim 1, further including a liquid/vapor separator disposed in fluid connection downstream of the gas cooler and upstream of the evaporator.

6. The refrigeration system of claim 5, further comprising a flash gas bypass valve disposed in fluid connection downstream of the liquid/vapor separator and upstream of the compressor.

7. The refrigeration system of claim 1, further comprising a low temperature evaporator and a low temperature expansion valve, wherein the expansion valve and the evaporator are configured to provide a first amount of superheat and wherein the low temperature expansion valve and the low temperature evaporator are configured to provide a second amount of superheat.

8. The refrigeration system of claim 7, further comprising a low temperature compressor disposed in fluid connection downstream of the low temperature evaporator and upstream of the compressor.

9. The refrigeration system of claim 1, further comprising a throttling valve disposed in fluid connection downstream of the gas cooler and upstream of the evaporator.

10. A gas cooler, comprising:

a direct heat exchanger configured to cool an evaporative coolant;

an indirect heat exchanger comprising a coil;

a distribution system for providing the evaporative coolant to the indirect heat exchanger, wherein the direct heat exchanger is configured to cool the evaporative coolant from a first temperature to a second temperature less than the first temperature prior to the evaporative coolant being provided to the indirect heat exchanger, and the distribution system is configured to distribute the evaporative coolant at the second temperature from the direct heat exchanger over the indirect heat exchanger to cool a refrigerant flowing through the coil of the indirect heat exchanger below a dry bulb ambient air temperature by transferring heat from the refrigerant to the evaporative coolant provided to the indirect heat exchanger.

11. The gas cooler of claim 10, wherein coils of the indirect heat exchanger are configured to withstand a pressure of at least 1000 pounds per square inch absolute (PSIA).

12. The gas cooler of claim 10, further comprising: a compressor configured to compress the refrigerant;

an evaporator disposed in fluid connection downstream of the gas cooler and upstream of the compressor; and an expansion valve disposed in fluid connection downstream of the gas cooler and upstream of the evaporator.

13. The gas cooler of claim 10, wherein the refrigerant is carbon dioxide and wherein the evaporative coolant is water.

14. The gas cooler of claim 10, further comprising a collection basin designed to collect the evaporative coolant that has passed over the indirect heat exchanger.

15. The gas cooler of claim 10, further including a fan to generate a flow of air across the indirect heat exchanger.

16. The gas cooler according to claim 12, further including a liquid/vapor separator disposed in fluid connection downstream of the gas cooler and upstream of the evaporator.

17. The gas cooler according to claim 16, further comprising a flash gas bypass valve disposed in fluid connection downstream of the liquid/vapor separator and upstream of the compressor.

18. The gas cooler according to claim 12, further comprising a low temperature evaporator and a low temperature expansion valve, wherein the expansion valve and the evaporator are configured to provide a first amount of superheat and wherein the low temperature expansion valve and the low temperature evaporator are configured to provide a second amount of superheat.

19. The gas cooler according to claim 18, further comprising a low temperature compressor disposed in fluid connection downstream of the low temperature evaporator and upstream of the compressor.

20. The refrigeration system according to claim 1, wherein the first distribution system includes a first basin and a first nozzle configured to distribute the evaporative coolant from the first basin at the first temperature to the direct heat exchanger, and a second distribution system including a second basin and a second nozzle configured to distribute the evaporative coolant at the second temperature from the second basin onto the indirect heat exchanger.

* * * * *